United States Patent [19]

Haigh et al.

[11] 4,407,645

[45] Oct. 4, 1983

[54] GEAR PUMP HAVING AN ISOLATOR TO PROTECT ITS BEARINGS

[75] Inventors: Harry Haigh, Cranbrook; Rudy C. Sonmor, Vancouver, both of Canada

[73] Assignee: R.C.S. Enterprises Limited, Vancouver, Canada

[21] Appl. No.: 282,207

[22] Filed: Jul. 10, 1981

[51] Int. Cl.[3] ..... F04C 15/00

[52] U.S. Cl. ..... 418/131

[58] Field of Search ..... 418/131, 132, 133, 134, 418/135, 144, 206

[56] References Cited

U.S. PATENT DOCUMENTS

| | | | |
|---|---|---|---|
| 2,391,577 | 12/1945 | Larson | 418/206 X |
| 2,714,856 | 8/1955 | Kane | 418/132 |
| 2,836,125 | 5/1958 | Funk | 418/206 |
| 3,059,584 | 10/1962 | Cottell | 418/206 X |
| 3,478,957 | 11/1969 | Harlin et al. | 418/266 X |

*Primary Examiner*—Leonard E. Smith

*Attorney, Agent, or Firm*—Fetherstonhaugh & Co.

[57] ABSTRACT

A hydraulic device, pump or motor, useful with the hydraulic fluid used in a mine. The device comprises a housing with an impeller within the housing. A drive shaft extends through the housing and carries the impeller. There are bearings for the shaft on either side of the impeller. The improvement is an isolator member positioned between each bearing and the impeller chamber to prevent contact between the bearing and the pumped hydraulic fluid. The invention reduces the damage to hydraulic pumps and motors without increasing fire risk within the mine and helps conserve oil. This latter advantage applies to use of the invention anywhere, including use outside a mine.

3 Claims, 2 Drawing Figures

GEAR PUMP HAVING AN ISOLATOR TO PROTECT ITS BEARINGS

FIELD OF THE INVENTION

This invention relates to a hydraulic motor or pump useful in a mine for pumping or being driven by a hydraulic fluid.

DESCRIPTION OF THE PRIOR ART

Mining and drilling equipment is most efficiently operated by hydraulic pumps and motors.

Generally hydraulic pumps and motors use a hydraulic fluid that is an oil, therefore, the lubrication of the bearings is not a problem. But with underground mining equipment, because of the fire hazard, regulations require the use of a water based oil product in all hydraulic systems. Therefore, in mining equipment, bearing lubrication is a problem. Water based fluid has resulted in greatly reduced pump and motor life (approximately 20% life), efficiency, speed and pressure in systems. A hydraulic fluid comprising 60 parts water and 40 parts of oil has been used in mining but there are regulations to be brought in that will require the fluid to comprise 95 parts of water and 5 parts of oil. Using the 60:40 combination the bearing failure rate among hydraulic pumps and motors which rely on the hydraulic fluid to lubricate the bearings is high. Using the 95:5 ration the bearing failure is extremely high.

SUMMARY OF THE INVENTION

Accordingly, the present invention seeks to provide a hydraulic device, a pump or motor, for use with hydraulic fluid and particularly useful in mines in which, in tests carried out, the failure rate has been extremely low. That is, there has been extended pump and motor life using the present invention. Extended life has also been provided for devices, pumps and motors, in systems using a standard hydraulic oil.

Accordingly, the present invention provides a pump or motor, useful with a hydraulic fluid in a mine, comprising: a housing an impeller within the housing; a drive shaft extending through the housing and carrying the impeller; bearings for the shaft at each end of the impeller; and is the improvement which is an isolator member positioned between the bearing and the chamber to prevent contact between the bearing and the pumped hydraulic fluid.

BRIEF DESCRIPTION OF THE DRAWINGS

Aspects of the invention are illustrated, merely by way of example, in the accompanying drawings in which.

DESCRIPTION OF THE PREFERRED EMBODIMENTS

Figure 1:
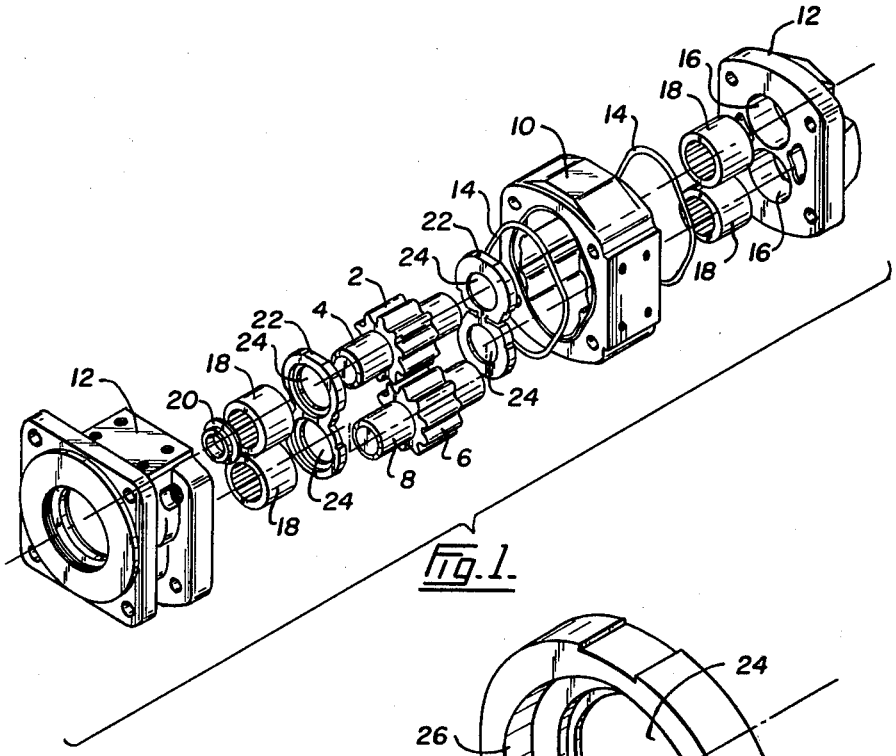
FIG. 1 is an exploded view of a pump according to the present invention.

The drawings illustrate a gear pump comprising a driven gear 2 on a driveable shaft 4 and an idler gear 6 engaging with the drive gear 2 and carried by an idler shaft 8. Liquid is pumped by the rotation of the gear members 2 and 6 impelling the liquid centrifugually in known manner. The drive shaft with key or spline to drive gear 2 and hub 4 is not shown as it can be many styles including integral with gear 2 and hub 4.

The pump comprises a main body 10 having end members 12. Sealing rings 14 are provided between the main body 10 and the end members 12. The end members 12 are provided with recesses 16 to receive bearings 18 to receive hubs 4 and 8. A shaft seal 20 is also shown for a drive shaft, which is earlier mentioned and not shown.

Details such as studs to hold the component parts of the pump together are also not shown. These components are entirely conventional.

Figure 2:
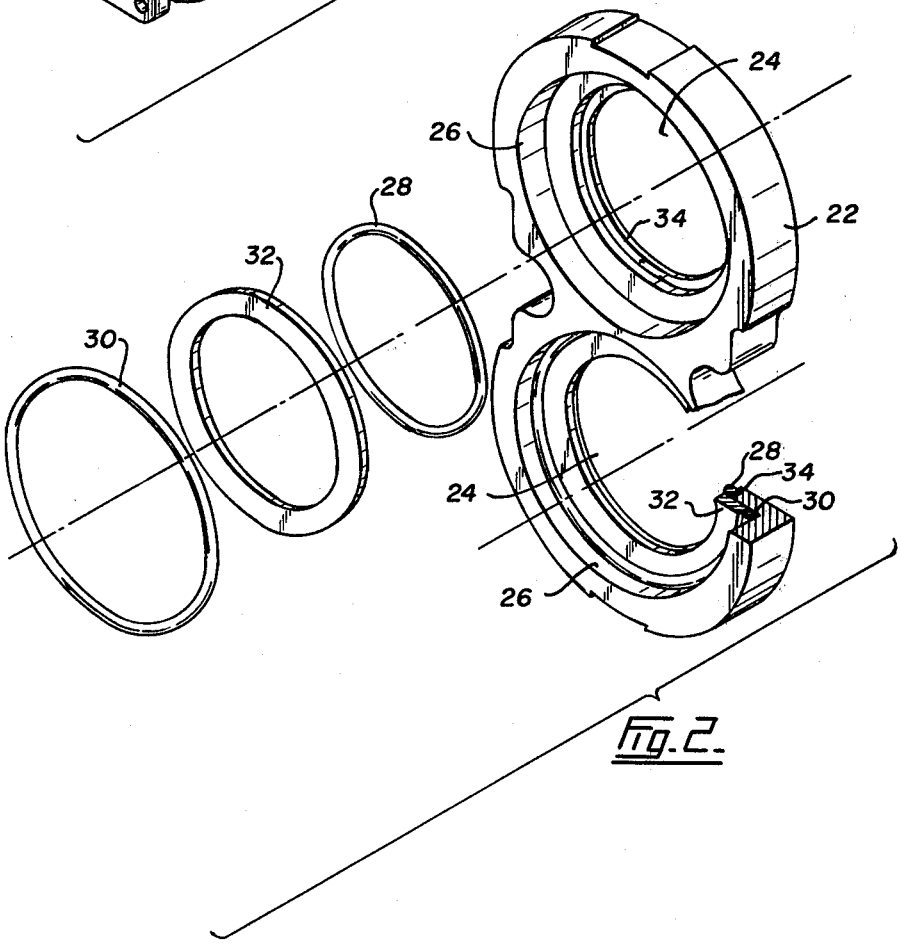
FIG. 2 is a view, partially exploded and partially in section, showing an isolator member useful in the pump of FIG. 1.

According to the invention there is a bearing isolator on each of the four hubs 4 and 8. As more clearly illustrated in FIG. 2 the isolator comprises a plate 22 having two openings 24 through. There are two recesses 34, and two recesses 26 to receive the bearings 18. Each recess 34 contains an O ring 28. A second O ring 30 engages the outer edge of the recess 26 and an annular plate 32 abuts both O rings to locate them within the recess.

It should be emphasized that the particular isolator illustrated in the form of two O rings and a plate locating the O rings within the recesses 26 and 34 may be replaced by other styles of isolators such as a one piece seal plate, isolating thrust plate etc., that is leak proof and will prevent hydraulic fluid moving from the body 10 past the isolators and on to the bearings 18. If such a leakage occurs the liquid will wash away the lubricant of the bearings and will cause their early failure. It should be noted that the bearings in the pump according to the present invention may be greased with bearing grease in conventional manner. In this way life of several thousand hours can be expected. If the isolator is not present, that is if the bearing relies upon hydraulic fluid for lubrication then an unacceptably low number of hours of life is the probable result.

A pump has been illustrated but the skilled man will appreciate that the invention is equally applicable to hydraulic motors. Similarly although a gear pump is shown, a vane-type device could also be illustrated.

We claim:

1. A gear pump useful with a hydraulic fluid having a water base, the gear pump comprising:

a housing;

a drive gear on a driveable hub and an idler gear engaging with the drive gear and carried by an idler hub, the drive hub and the idler hub each being mounted in bearings at both ends of the housing;

an isolator between each bearing and the hydraulic fluid, said isolator comprising a recess to receive an end of each bearing;

a sealing member positioned within each recess to seal against the outer surface of the shaft at the sealing members inner edge and to seal against the outer edge of the recess at the sealing member's outer edge.

2. A device as claimed in claim 1 in which the sealing member comprises a first O ring to engage the shaft;

a second O ring to engage the outer edge of the recess;

a plate abutting both O rings to locate them within the recess.

3. A device as claimed in claim 2 in which the first ring is of PTFE and in which the second O ring is of neoprene.

* * * * *